United States Patent [19]

McCarty

[11] 4,359,876

[45] Nov. 23, 1982

[54] ROOM AIR CONDITIONER SENSOR APPLICATION

[75] Inventor: William J. McCarty, Louisville, Ky.

[73] Assignee: General Electric Company, Louisville, Ky.

[21] Appl. No.: 235,264

[22] Filed: Feb. 17, 1981

[51] Int. Cl.[3] ..... F25D 17/00

[52] U.S. Cl. ..... 62/180; 62/325

[58] Field of Search ..... 62/325, 180

[56] References Cited

U.S. PATENT DOCUMENTS

| | | | |
|---|---|---|---|
| 2,321,242 | 6/1943 | Ramsey . | |
| 2,391,151 | 12/1945 | Gibson | 62/325 |
| 2,432,587 | 12/1947 | Ramsey . | |
| 2,911,797 | 11/1959 | Stocking | 62/325 X |
| 2,975,611 | 3/1961 | Pietsch | 62/325 X |
| 2,987,894 | 6/1961 | Lancaster . | |
| 3,143,864 | 8/1964 | Schordine | 62/325 |
| 3,293,875 | 12/1966 | Kelly | 62/180 |
| 3,621,669 | 11/1971 | Nichols et al. | 62/157 |
| 3,785,166 | 1/1974 | Schrader | 62/227 |

*Primary Examiner*—Lloyd L. King

*Attorney, Agent, or Firm*—Frank P. Giacalone; Radford M. Reams

[57] ABSTRACT

A room air conditioner of the air valve heat pump type wherein a solid state narrow differential thermal sensor is arranged on a heat exchange baffle that senses room ambient. The sensor is insulated to eliminate biasing the sensor with outdoor and component heat transfer. The sensor through the baffle follows room ambients and is cooled when the cooling cycle is terminated by cold air from evaporator located above the baffle and when the heating cycle is terminated the sensor is heated as warm air from the condenser located below the baffle rises over the baffle to raise the temperature of the sensor to prevent short cycling of the air conditioner on either the cooling or heating mode.

5 Claims, 5 Drawing Figures

FIG. 1
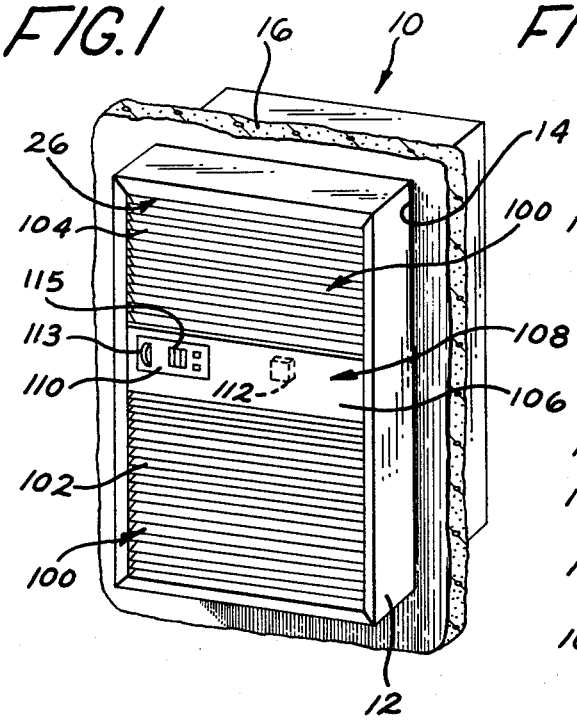
FIG. 2
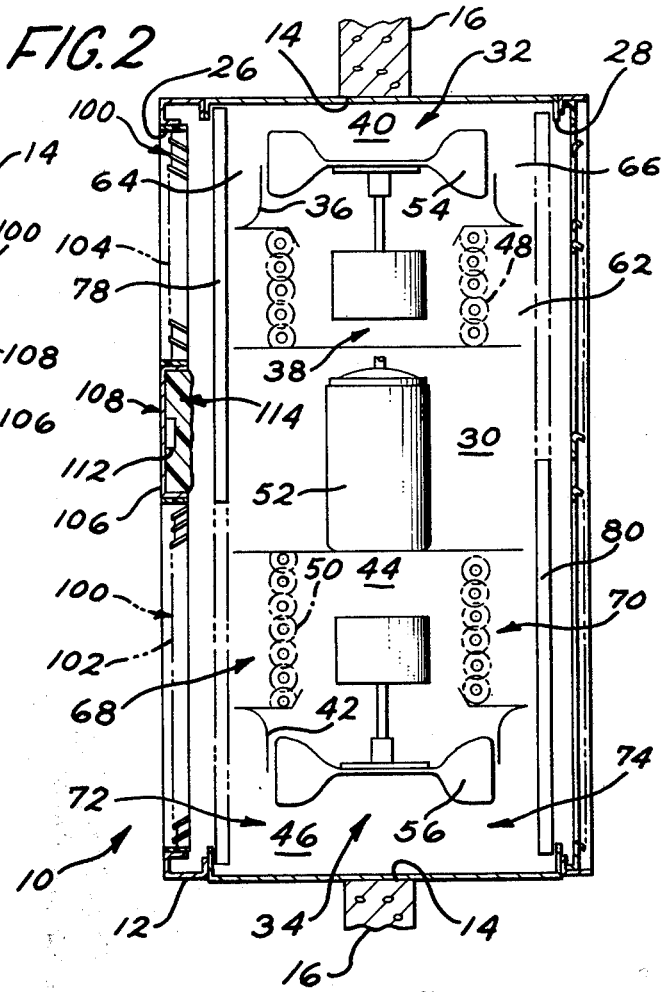
FIG. 3
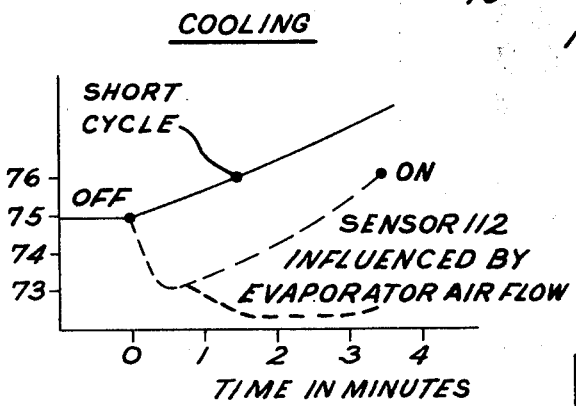
FIG. 4
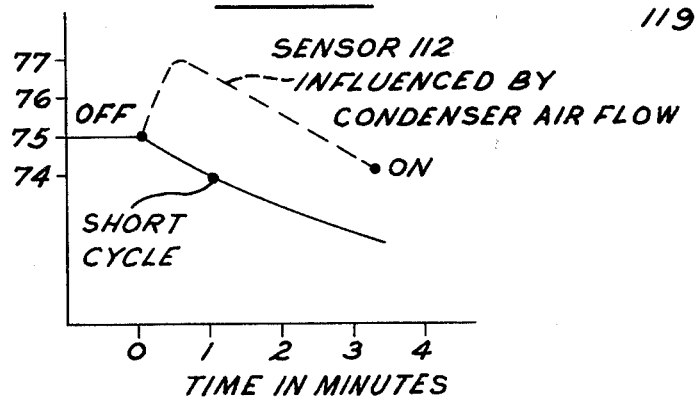
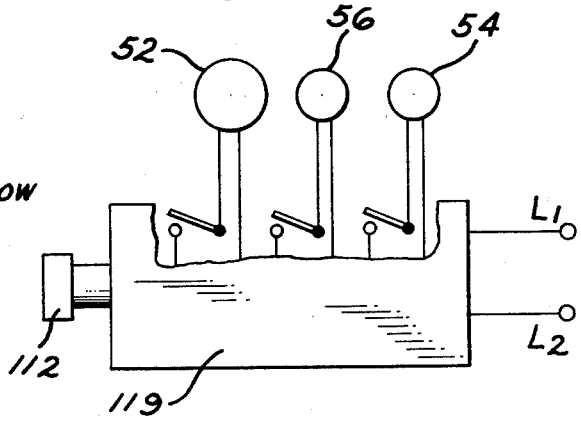
FIG. 5

ROOM AIR CONDITIONER SENSOR APPLICATION

BACKGROUND OF THE INVENTION

The present invention relates to room air conditioners known as heat pumps of the reverse air cycle type shown and described in U.S. Pat. No. 4,297,854 - McCarty et al, issued Nov. 3, 1981 and assigned to the assignee of the present application. The air conditioning unit includes a solid state sensing device having a narrow temperature differential that is arranged to eliminate short cycling of the unit compressor during rapid ambient temperature rise when the unit is in the cooling mode and rapid ambient temperature drop when the unit is in the heating mode.

The application of sensing units having a narrow temperature differential is desirable in that the ambient temperature of an enclosure to be conditioned can be maintained within a degree or two of a set temperature. However, in situations where the enclosure temperature changes rapidly or within a short time, the cycling of the compressor may occur while the compression unit is still under relatively high pressure conditions. The premature starting of the compressor while appropriate relative to temperature control will, in many instances, result in failure of the compressor to start and, in isolated instances, result in compressor damage.

A general object of the present invention is to provide a room air conditioning control that has a narrow temperature differential and which is arranged to prevent short cycling of the compressor in the heating or cooling mode.

Another object of the present invention is to arrange the solid state sensor so that during the period of time immediately following the compressor deenergization, the sensor is exposed to refrigeration system heat exchanger temperature.

A fourth object of the present invention is to arrange the solid state sensor relative to the condenser and evaporator so that during the period of time immediately following compressor deenergization in the heating mode, the sensor is exposed to condenser temperature to raise the temperature sensed by the sensor and, in the cooling mode, the sensor is exposed to evaporator temperature to lower the temperature sensed by the sensor.

SUMMARY OF THE INVENTION

In accordance with the preferred embodiment of the invention, there is provided an air conditioning apparatus for heating or cooling the air in an enclosure having a wall opening. The air conditioning apparatus comprising a housing having openings on opposite sides thereof being adapted to be positioned in the wall opening with the opening on one side of facing the outdoors and the opening on the other side facing the enclosure. The housing includes a central chamber dividing it into an evaporator compartment and a condenser compartment.

The refrigerating system includes a condenser in the condenser compartment, an evaporator in the evaporator compartment and, a compressor in the central chamber. Air moving means in each compartment are arranged for recirculating enclosure air through their respective compartment.

Mounted on the housing is a front panel including louvered portions arranged over the inlet and outlets of each compartment and having a heat exchange baffle between the louvered portions exposed to the enclosure ambient temperature.

Movable between a heating and cooling mode is an indoor damper slidably arranged in the indoor facing side of the housing that is dimensioned to cover alternatively the openings of the evaporator compartment in the heating mode so that air circulating through the condenser heats the enclosure or, the openings of the condenser compartment in the cooling mode so that air circulating through the evaporator compartment cools the enclosure. An outdoor damper is slidably arranged in the outdoor facing side of the housing for circulating outdoor air through the compartment having its indoor openings closed by the indoor damper;

A solid state sensor is mounted juxtapositioned on the heat exchange baffle for sensing a set Off and On temperature of the enclosure ambient temperature.

The sensor is thermally insulated from the internal temperatures of the housing and refrigeration system components so that during the cooling mode when the compressor and air moving means are deenergized by the sensor sensing the set OFF position, residual air from the evaporator will flow by natural convection down over the heat exchange baffle to lower the temperature sensed by the sensor to below the set ON temperature. During the heating mode when the compressor and air moving means are deenergized by the sensor sensing the set Off position residual air from the condenser will rise and flow by natural convection over the heat exchange baffle to raise the temperature sensed by said sensor to above the set On temperature, thereby preventing premature reactivation of the compressor and air moving means.

BRIEF DESCRIPTION OF THE DRAWINGS

FIG. 1 is a perspective view showing an air conditioning unit incorporating the present invention;

FIG. 2 is a schematic side elevation showing the arrangement of the air conditioning unit and relative position of the sensor; and FIG. 3 is a schematic chart of time versus temperature for an exemplification cooling mode operation of the air conditioning unit of FIG. 1;

FIG. 4 is a schematic chart of time versus temperature for an exemplification heating mode operation of the air conditioning unit of FIG. 1;

FIG. 5 is a schematic showing of a simplified control circuit.

DESCRIPTION OF THE PREFERRED EMBODIMENT

Referring now to the drawings and more particularly to FIGS. 1 and 2, there is shown an air conditioning unit 10 of the reverse air cycle type fully disclosed in the above mentioned U.S. Pat. No. 4,297,854 and said patent is hereby incorporated by reference.

Air conditioning unit 10 includes a housing 12 that is adapted to be arranged in an opening 14 in the wall 16 of an enclosure to be conditioned. The housing walls define generally a front opening 26 disposed on the enclosure side of wall 16 and a rear opening 28 disposed in the outdoor side of the wall 16. The housing is divided by partitions 33 and 35 to form a central machine chamber 30 separating an upper evaporator compartment 32 and a lower condenser compartment 34. A fan shroud 36 substantially divides the evaporator compartment 32 into an inlet area 38 and an outlet area 40. A fan shroud 42 substantially divides the condenser compartment 34 into an inlet area 44 and an outlet area 46. Mounted in the housing 12 is an evaporator 48 arranged in the inlet area 38 of compartment 40, a condenser 50 arranged in the inlet area 44 of compartment 34, and the compressor 52 arranged in the chamber 30. Air is circulated by a fan 54 in shroud 36 from the evaporator inlet area 38 to the outlet area 40 and similarly air is circulated by a fan 56 in shroud 42 from the condenser inlet area 44 to outlet area 46.

The inlet and outlet areas of the evaporator and condenser compartments are arranged with the housing 12 with each area having a pair of openings therein, one communicating with the opening 28 facing the outdoor, and a second opening communicating with the opening 26 facing the enclosure whereby air can be both introduced and discharged from the evaporator and condenser compartments in two different directions. More specifically, the evaporator inlet area 38 contains openings 60 and 62 and the outlet area 40 contains openings 64 and 66 in the indoor and outdoor side respectively of housing 12. Similarly, condenser compartment inlet area 44 is provided with openings 68 and 70 and the outlet area 46 is provided with openings 72 and 74 in the indoor and outdoor side respectively of housing 12.

A pair of dampers 78 and 80 are provided for controlling air flow through the compartments 32 and 34 which are arranged for vertical movement in openings 26 and 28 respectively. The dampers 78 and 80 are interconnected by suitable cables (not shown) to insure proper location of one damper over a compartment inlet and outlet on one side of the housing by movement of the damper arranged on the other side of the housing. The cable system interconnecting the indoor and outdoor dampers is fully explained in the U.S. Pat. No. 4,297,854.

In the heating mode, the dampers 78 and 80 are arranged in the position shown in FIG. 2 wherein air flow through the condenser chamber 34 is used to heat the air circulated from the enclosure. That is in the heating mode, the damper 78 closes the evaporator compartment inlet opening 60 and outlet opening 64 on the enclosure side opening 26 of housing 12 so that outdoor air is circulated through evaporator compartment 32 and, the damper 80 closes the condenser compartment inlet opening 28 of housing 12 so that enclosure air is circulated through the condenser compartment 34 to warm the enclosure air recirculating therethrough. In the cooling mode, the indoor damper 78 would be positioned over the enclosure side condenser inlet 68 and outlet 72 area opening, and the outdoor damper 80 would be positioned over the outdoor side evaporator inlet 62 and outlet 66 area opening so that outdoor air is circulated through the condenser chamber 34 and enclosure air is circulated through the evaporator chamber 40 to cool the enclosure air.

Arranged over the front or indoor opening 26 of housing 12 is a front grille or appearance member 100 that includes a louvered portion 104 positioned over inlet 60 and outlet 64 of evaporator chamber 32 and a louvered portion 102 positioned over the inlet 68 and outlet 72 of the condenser chamber. A central control panel 106 is located between louvers 102 and 104 and generally positioned in the area of chamber 30 between the compartments 32 and 34.

The control panel 106 includes a front heat exchange baffle 108 exposed to enclosure ambient temperature. The air conditioner control components 110 including the control module 119 (FIG. 5) may be mounted on the baffle for convenient access. For example, a temperature control means 113 and fan operation buttons 115 may be mounted in the panel 106.

In carrying out the present invention, a low cost solid state sensor 112 is employed having a narrow differential capable of maintaining the enclosure temperature within approximately 1° to 1.5° of the set temperature. Maintaining an area temperature within 1° to 1.5° degrees of a set temperature is desirable. However, in using a sensor having narrow differential, it is not uncommon to experience short cycling of the compressor. This is especially true when the ambient temperature being controlled, for any number of reasons, rises or drops quickly from the set OFF temperature. By the present invention, a desirable sensor having a narrow temperature differential is used in a manner that maintains the temperature of the enclosure within 1° to 1.5° F. while it eliminates the problem of compressor chart cycling during rapidly changing enclosure temperature conditions. To this end, the sensor 112 is mounted juxtapositioned on the interior wall of the baffle 108. The baffle presents a relatively large heat exchange surface to the enclosure to be conditioned and, accordingly, the sensor tracks the enclosure ambient. The sensor is thermally isolated from the interior of the housing by insulation 114 to insure that sensor 112 is not influenced by temperature conditions other than enclosure ambient such as outdoor or refrigeration system component temperature.

Referring now to FIG. 2 and the schematic chart of FIG. 4 relating to the heating mode, the compressor is deenergized when the ambient temperature of the enclosure is at the set OFF temperature selected for purpose of illustrating the operation of the system to be 75° F. At this point in time, the heat emanating from still relatively warm condenser 50 rises by natural convection and flows across the front enclosure side of baffle 108 causing the temperature sensed by the baffle to increase by two degrees F.° above the enclosure ambient as shown in dotted lines on FIG. 4. The compressor is prevented from turning on prematurely since the enclosure ambient must lower the temperature sensed by sensor 112 from this heated position of approximately 3° F. above the set ON temperature which is approximately 1° F. below the OFF set temperature. In the situation when the temperature of the enclosure drops slowly, the influence of condenser warm air on the sensor has no effect since the sensor is influenced by enclosure ambient by virtue of its placement on the relatively large heat exchange surface of the front baffle 108.

Referring now to FIG. 2 and the schematic chart of FIG. 3 relating to the cooling mode, the compressor is deenergized when the ambient temperature of the enclosure is at the set OFF temperature selected for purpose of illustrating the operation of the system to be 75°. At this point in time, the cold air emanating from the still relatively cold evaporator 48 falls by natural convection and flows across the front enclosure side of baffle 108 causing the temperature of the sensor to decrease by 2° F. below the enclosure ambient as shown in dotted lines on FIG. 3. The compressor in this instance is prevented from turning on prematurely since the enclosure ambient must raise the temperature of the sensor 112 from the cooled position of approximately 3° F. below the set ON temperature which is approximately 1° F. above the OFF set temperature. In this situation, as the temperature of the enclosure rises slowly, the influence of the evaporator cold air on the sensor has no effect since the sensor is influenced by enclosure ambient by virtue of its placement on the relatively large heat exchange surface of the front baffle 108.

In carrying out the present invention, the sensor used had a temperature differential of 1.5° F. The temperature of the sensor in the heating mode was consistently raised between 2.0° and 3.0° above the set OFF temperature by air flow from the condenser while in the cooling mode the temperature of the sensor was lowered between 2.0° and 3.0° below the set OFF temperature by air flow from the evaporator.

The configuration of the air conditioning unit capable of heating and cooling as shown allows the placement of the sensor to be below the evaporator to allow the cold air therefrom to fall naturally across the baffle in the cooling mode while allowing the warm air from the lower positioned condenser to flow upwardly naturally across the baffle in the heating position.

In summary, by the present invention, a temperature sensing means is provided that effectively biased the sensor in both the heating and cooling mode of operation without the use of external components that prevent short cycling in either mode. FIG. 5 disclosed a schematic control circuit wherein the control module 119 is represented by an enclosure having at least switch means for controlling operation of the compressor 52 and fans 54, 56 through switches 120, 122 and 124 respectively. The control module 119 receives temperature input from sensor 112 and may be connected to a power source through lines L1 and L2. It should be noted that the control module or system does not form a part of this invention and any of a number of circuits may be employed to control operation of the compressor and fans including circuit means for cycling the fans during compressor OFF periods.

I claim:

1. An air conditioning apparatus for conditioning air in an enclosure having a wall opening comprising:

a housing having openings on opposite sides thereof and adapted to be positioned in said wall opening with the opening on one side of said housing facing the outdoors and the opening on the other side of said housing facing indoors of the enclosure:

a central chamber defined by spaced partition means dividing said housing into an evaporator compartment and a condenser compartment;

a refrigerating system including a condenser in said condenser compartment, an evaporator in said evaporator compartment and a compressor in said central chamber;

each of said compartments having an inlet and an outlet communicating with said indoor facing opening of said housing;

air moving means in each of said compartments for recirculating enclosure air through each of said compartments;

a front panel including louvered portions arranged over the inlet and outlets of each of said compartments and having a heat exchange baffle positioned between said louvered portions and exposed to the enclosure ambient temperature;

a sensor mounted in juxtaposition to said heat exchange baffle and insulation thermally isolating said baffle and sensor from the interior of said housing so that, when said compressor and air moving means are de-energized, residual air from within said housing will flow by natural convention over said heat exchange baffle to affect the temperature sensed by said sensor to prevent premature re-energization of said compressor and said air moving means.

2. The air conditioning apparatus of claim 1 wherein said heat exchange baffle is positioned substantially in alignment with said central chamber.

3. The air conditioning apparatus of claim 2 wherein a damper means is movable between a heating and cooling mode, said damper means including an indoor damper slidably arranged in the indoor facing side of said housing and being dimensioned to cover alternatively said indoor inlet and outlet of said evaporator compartment in said heating mode so that air circulates through said condenser compartment for heating said enclosure or, said indoor inlet and outlet of said condenser compartment in said cooling mode so that air circulates through said evaporator compartment for cooling the enclosure, an outdoor damper slidably arranged in the outdoor facing side of said housing and being associated with outdoor facing inlets and outlets of said compartments for circulating outdoor air through the compartment having its indoor inlet and outlet closed by said indoor damper.

4. An air conditioning apparatus for conditioning air in an enclosure having a wall opening comprising:

a housing having openings on opposite sides thereof and adapted to be positioned in said wall opening with the opening on one side of said housing facing the outdoors and the opening on the other side of said housing facing indoor of the enclosure;

a central chamber defined by spaced partition means dividing said housing into an evaporator compartment and a condenser compartment;

a refrigerating system including a condenser in said condenser compartment, an evaporator in said evaporator compartment and a compressor in said central chamber;

each of said compartments having an inlet and an outlet communicating with said indoor facing opening of said housing;

air moving means in each of said compartments for recirculating enclosure air through each of said compartments;

a front panel including louvered portions arranged over the inlet and outlets of each of said compartments and having a heat exchange baffle positioned between said louvered portions and exposed to the enclosure ambient temperature;

damper means, movable between a heating and cooling mode, including an indoor damper slidably arranged in the indoor facing side of said housing and being dimensioned to cover alternatively indoor inlet and outlet of said evaporator compartment in said heating mode so that air circulates through said condenser compartment for heating said enclosure or, said indoor inlet and outlet of said condenser compartment in said cooling mode so that air circulates through said evaporator compartment for cooling said enclosure, an outdoor damper slidably arranged in the outdoor facing side of said housing and being associated with outdoor facing inlets and outlets of said compartments for circulating outdoor air through the compartment having its indoor inlet and outlet closed by said indoor damper;

a solid state sensor mounted juxtapositioned on said heat exchange baffle for sensing a set OFF and ON temperature of the enclosure ambient temperature;

means thermally insulating said heat exchange baffle and solid state sensor from the interior of said housing so that during the cooling mode, when said compressor and air moving means are deenergized by said sensor sensing the set OFF temperature, residual air from said evaporator compartment will flow by natural convection over said heat exchange baffle to lower the temperature sensed by said sensor to below said set ON temperature, and during the heating mode, when said compressor and air moving means are deenergized by said sensor sensing the set OFF temperature, residual air from said condenser compartment will flow by natural convection over said heat exchange baffle to raise the temperature sensed by said sensor to above said set ON temperature thereby preventing premature reactivation of said compressor and air moving means.

5. The air conditioning apparatus of claim 4 wherein said heat exchange baffle is positioned substantially in alignment with said central chamber.

* * * * *